United States Patent [19]

Ruhstrofer et al.

[11] Patent Number: 4,776,933

[45] Date of Patent: Oct. 11, 1988

[54] ELECTROCHEMICAL POLISHING AND PICKLING METHOD AND APPARATUS

[75] Inventors: Friedrich Ruhstorfer, Garching; Jürgen Menzel, Munich, both of Fed. Rep. of Germany; Georg Henkel, Waidhofen/Thaya, Austria

[73] Assignee: Poligrat GmbH, Fed. Rep. of Germany

[21] Appl. No.: 42,170

[22] Filed: Apr. 24, 1987

[30] Foreign Application Priority Data

Apr. 25, 1986 [EP] European Pat. Off. ..... 86105747.9

[51] Int. Cl.[4] ..... C25F 1/02; C25F 3/16; C25D 17/14

[52] U.S. Cl. ..... 204/129.7; 204/141.5; 204/224 M; 204/237; 204/269; 204/271

[58] Field of Search ..... 204/129.1, 130, 141.5, 204/224 R, 224 M, 237, 129.7, 269, 271

[56] References Cited

U.S. PATENT DOCUMENTS

| | | | |
|---|---|---|---|
| 3,546,088 | 12/1970 | Barkman et al. | 204/271 X |
| 3,637,468 | 1/1972 | Icxi et al. | 204/271 X |
| 3,779,887 | 12/1973 | Gildone | 204/271 X |
| 4,431,501 | 2/1984 | Leppanen | 204/271 X |

*Primary Examiner*—Donald R. Valentine
*Attorney, Agent, or Firm*—Woodard, Emhardt, Naughton, Moriarty & McNett

[57] ABSTRACT

It is provided in an electrochemical polishing and pickling method and apparatus for treating metal surfaces that an electrolyte stream (18) entering a casing (12) is divided into an anodic partial stream (20) and a cathodic partial stream (22). The anodic partial stream (20) flows past a dielectric wall (32) as well as the surface (10') to be polished or pickled, while the cathodic partial stream does not reach the surface (10') to be polished but instead is recycled directly into an electrolyte reservoir (30) after having passed the cathodes (24).

20 Claims, 1 Drawing Sheet

ELECTROCHEMICAL POLISHING AND PICKLING METHOD AND APPARATUS

Figure 1:
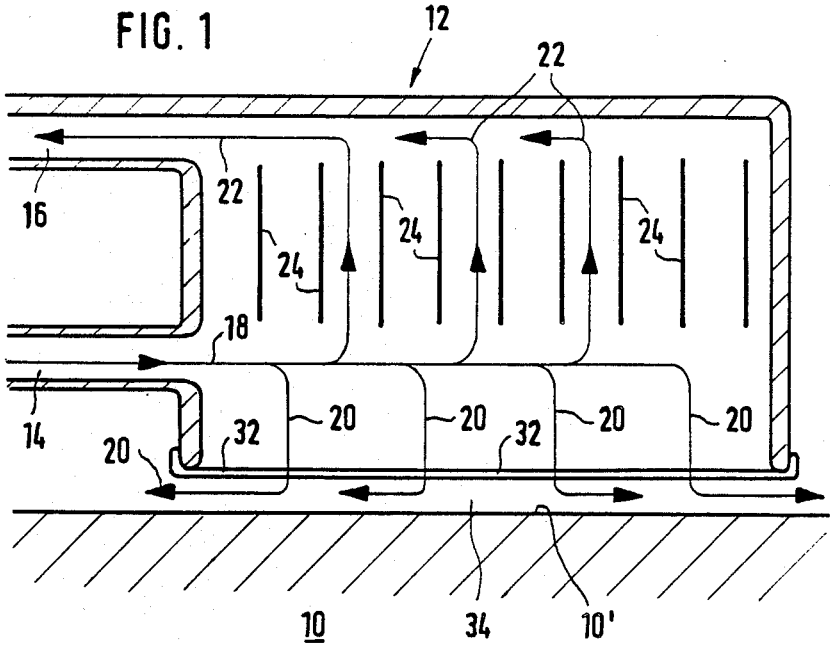

The instant invention relates to a method of electrochemically polishing and/or pickling, wherein an electrolyte stream is passed along the anodic surface to be polished and/or pickled, one or more cathodes being arranged opposite the surface.

The invention likewise relates to an apparatus for partially electrochemically polishing and/or pickling, comprising a casing (so-called tampon) adapted to be placed on the anodic surface area to be polished and/or pickled and having an inlet and an outlet for an electrolyte as well as one or more cathodes and a wall adjacent the surface area and made substantially of a dielectric, the wall being permeable to the electrolyte and defining a working gap together with the surface for the electrolyte stream.

A method of this kind and a corresponding apparatus are known from DE-OS No. 29 37 747.

With the known electrochemical polishing and/or pickling method the cathodic and anodic areas of the system are passed by the same electrolyte stream, in other words, the electrolyte flows past both the cathode and the anodic surface to be polished.

In the partial electrochemical polishing and/or pickling a casing, the so-called tampon, is placed on the surface area to be processed and then the polishing or pickling procedure is carried out. Subsequently the housing is placed on another surface section to be processed.

It is a disadvantage above all of the known methods and apparatus with which the electrolyte stream impinging on the surface to be polished first has passed the cathodes that this electrolyte stream entrains the hydrogen gas which has been developed at the cathodes. This hydrogen gas contained in the elec-trolyte is the cause of a number of disadvantages: the hydrogen gas entrained in fine bubbles in the electrolyte stream impairs the permeability of the dielectric to the electrolyte. For this reason loose, large-pore non-woven material must be used as the dielectric in the case of the prior art and this material is of little resistance against high temperatures and besides subject to great wear. Consequently the dielectric must be exchanged frequently with the known method and apparatus and this involves a lot of work and is expensive.

Another consequence of the high proportion of hydrogen gas in the electrolyte stream is that the electrolyte is displaced by the expanding gas in the working gap if the temperature of the electrolyte increases greatly. Heat thus can no longer be dissipated and local overheating is the result. This may damage the dielectric as well as the metal surface to be processed.

With the prior art, therefore, the hydrogen gases entrained in the electrolyte stream restrict the choice of the dielectric and the current densities which may be applied in working are limited as well in order to prevent the temperatures from rising above critical values.

In the case of the prior art from which the instant invention starts the gases generated at the cathode and at the anodic surfaces, namely hydrogen and oxygen are brought together at a ratio of 2:1 whereby dangerous oxyhydrogen gas is formed so that corresponding safety measures must be taken against detonations.

It is, therefore, an object of the instant invention to develop a method of the kind recited initially as well as a corresponding apparatus such that effective electrochemical polishing or pickling can be carried out at high current density. It is another object of the instant invention to allow a greater choice of dielectric than the prior art and to exclude the risk of damage done to the metal surface to be polished.

As regards the method, this object is met, in accordance with the invention, in that the electrolyte stream is divided into at least two partial streams, namely an anodic partial stream which flows past the surface but not past the cathodes and a cathodic partial stream which flows past the cathodes but not past the surface.

In the case of the apparatus according to the invention designed to meet the underlying object measures are likewise taken to divide the electrolyte stream into anodic and cathodic partial streams.

The electrolyte partial stream flowing past the dielectric wall and the metal surface to be polished, in accordance with the invention, thus does not carry any hydrogen gas so that all the disadvantages of the prior art mentioned initially are eliminated. The hydrogen gas generated at the cathodes is entrained exclusively in the cathodic partial stream which does not reach the working area but instead is discharged directly.

Therefore, material which is resistant to high temperatures and wear may be used as the dielectric because the dielectric wall (in other words the dielectric) is passed only by an electrolyte which is free of gas. As the risk of local high temperatures is avoided as well, the work may be done at very high current densities, whereby the polishing or pickling efficiency is improved.

Furthermore, the dangerous formation of oxyhydrogen gas is avoided by the separation according to the invention of anodic and cathodic electrolyte streams.

As a result of the stoichiometric ratio between hydrogen and oxygen (2:1) the proportion of gas in the working area at the metal surface is reduced by $\frac{2}{3}$ with the method according to the invention and a corresponding apparatus, as compared to the state of the art (the hydrogen gas does not reach the working zone). The risk of displacement of the electrolyte at the metal surface in case of increased temperature is reduced accordingly. The electrolyte thus is better suitable to fulfill its function as a coolant at the metal surface and the risk of local overheating of the metal surface which might cause damages of the same is reduced to a minimum.

A textile polytetrafluoroethylene fabric has proved to be especially suitable and effective as the dielectric.

Other suitable dielectric materials are glass fiber fabrics and other materials which are resistant against high temperatures, acid, and abrasion.

It showed that the apparatus according to the invention can be used with a high degree of efficiency also for the anodic pickling of welding seams When processing steels containing chromium and nickel or chromium, the heat-treated areas at the welding seams must be cleaned by pickling to remove the oxide coatings in order to improve the corrosion resistance of the material. It is known to pickle such welding seams by treating them with mixtures of acids, especially nitric acid/hydrofluoric acid or nitric acid/hydrochloric acid. The apparatus and method according to the invention make it possible to remove any such oxide coatings effectively by using much less dangerous acids, like sulfuric acid, phosphoric acid, and the like in aqueous solution. It is an additional advantage that the degree of shine obtainable can be varied and adapted to the respective overall surface by varying the acid concentration so that no optically disturbing pickling stripes are formed.

The casings (tampons) provided according to the invention are limited in size. Yet any desired number of such casings may be combined to form greater polishing and pickling units so that large area workpieces can be processed at high efficiency and good quality in any desired position, e.g. horizontally, vertically, or "upside down".

Figure 2:
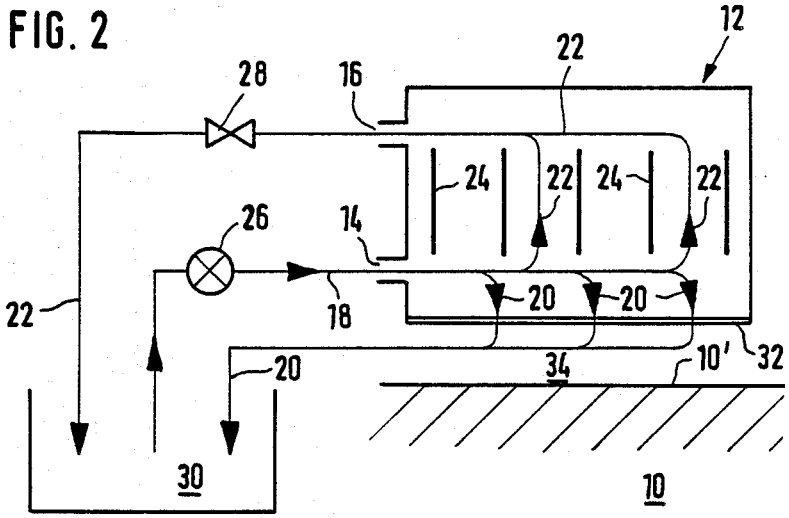

The invention will be described further, by way of example, with reference to the accompanying drawings, in which:

FIG. 1 is a diagrammatic sectional elevation of an apparatus for electrochemically polishing and/or pickling, and FIG. 2 shows the apparatus according to FIG. 1, including the entire electrolyte circuit.

As shown in FIG. 1, the surface 10' of a body 10 made of steel or aluminum is to be polished or pickled electrochemically. A casing 12 (tampon) is placed on the surface section to be processed. The electrolyte is introduced into the casing 12 through an inlet 14 and partly discharged through an outlet 16. The electrolyte stream 18 entering through the inlet 14 is divided into an anodic partial stream 20 and a cathodic partial stream 22.

The cathodic partial stream 22 flows past the cathodes 24, leaving the casing 12 through the outlet 16 without reaching the surface 10' to be polished or pickled. Therefore, the hydrogen gases generated at the cathodes 24 are carried out of the casing 12 in the cathodic partial stream 22.

Adjacent the surface 10' to be polished or pickled the casing 12 includes a dielectric wall 32. The dielectric material used, for instance, may be a textile polytetrafluoroethylene fabric or a glass fiber fabric. The anodic partial stream 20 flows through the dielectric wall 32 without being loaded with hydrogen gas. Having passed the dielectric wall 32, the anodic partial stream of the electrolyte enters the working gap 34 which is defined between the dielectric wall 32 and the surface 10'. Surface 10' is anodically connected to complete the circuit, thus allowing electrochemical polishing and/or pickling to be performed upon surface 10'. The oxygen gas generated is carried out of the working gap 34 in the direction of the arrows together with the anodic partial stream 20.

FIG. 2 is an overall presentation of the electrolyte circuit, the structural members corresponding to the apparatus shown in FIG. 1 being marked by the same reference numerals so that reference may be made to the description above. The anodic partial stream 20 leaving the working gap 34 is led into an electrolyte reservoir 30. Also the cathodic partial stream 22 is recycled into the electrolyte reservoir 30 by way of a control valve 28, however, without having contacted the surfaee 10' to be polished. Fresh electrolyte from the electrolyte reservoir 30 is refilled into the casing 12 through the inlet 14 by means of a pump 26. The electrolyte stream 18 entering the casing 12 through the inlet 14 then is divided into the anodic and cathodic partial streams, as described above.

What is claimed is:

1. A method of electrochemically polishing and/or pickling comprising passing an electrolyte stream along the anodic surface to be polished and/or pickled, one or more cathodes being arranged opposite the surface, with the electrolyte stream being divided into at least two partial streams, namely an anodic partial stream which flows past the surface but not past the cathodes and a cathodic partial stream which flows past the cathodes but not past the surface.

2. The method as claimed in claim 1 in which welding seams are anodicly pickled.

3. The method as claimed in claim 2 in which the anodicly picked welding seams are of stainless steel.

4. An apparatus for partially electrochemically polishing and/or pickling, comprising a casing adapted to be placed on the anodic surface area to be polished and/or pickled and having an inlet and an outlet for an electrolyte as well as one or more cathodes and a wall adjacent the surface area and made substantially of a dielectric, the wall being permeable to the electrolyte and defining a working gap together with the surface for the electrolyte stream, and in which said electrolyte stream is divided in the casing such that an anodic partial stream flows past said dielectric wall but not past said cathodes and a cathodic partial stream flows past said cathodes but not past said dielectric wall.

5. The apparatus as claimed in claim 4 in which said dielectric wall is made at least in part of a textile polytetrafluoroethylene fabric.

6. The apparatus as claimed in claim 5 in which said dielectric wall is made at least in part of a glass fiber fabric.

7. The apparatus as claimed in claim 5 in which said cathodic and anodic partial streams, having passed said casing and said working gap, respectively, are recycled into an electrolyte reservoir.

8. The apparatus as claimed in claim 5 in which said inlet for the electrolyte into said casing is disposed between said cathodes and said dielectric wall, and in which said outlet is disposed at the side of said cathodes remote from said dielectric wall.

9. The apparatus as claimed in claim 4 in which said dielectric wall is made at least in part of a glass fiber fabric.

10. The apparatus as claimed in claim 9 in which said cathodic and anodic partial streams, having passed said casing and said working gap, respectively, are recycled into an electrolyte reservoir.

11. The apparatus as claimed in claim 9 in which said inlet for the electrolyte into said casing is disposed between said cathodes and said dielectric wall, and in which said outlet is disposed at the side of said cathodes remote from said dielectric wall.

12. The apparatus as claimed in claim 4 in which said cathodic and anodic partial streams, having passed said casing and said working gap, respectively, are recycled into an electrolyte reservoir.

13. The apparatus as claimed in claim 12 in which said inlet for the electrolyte into said casing is disposed between said cathodes and said dielectric wall, and in which said outlet is disposed at the side of said cathodes remote from said dielectric wall.

14. The apparatus as claimed in claims 12 in which the anodic surface area being pickled are welding seams.

15. The apparatus as claimed in claim 14 in which the welding seams are of stainless steel.

16. The apparatus as claimed in claim 4 in which said inlet for the electrolyte into said casing is disposed between said cathodes and said dielectric wall, and in which said outlet is disposed at the side of said cathodes remote from said dielectric wall.

17. The apparatus as claimed in claims 8 in which the anodic surface area being pickled are welding seams.

18. The apparatus as claimed in claim 17 in which the welding seams are of stainless steel.

19. The apparatus as claimed in claims 4 in which the anodic surface area being pickled are welding seams.

20. The apparatus as claimed in claim 19 in which the welding seams are of stainless steel.

* * * * *